US010777929B2

(12) United States Patent
Hwang et al.

(10) Patent No.: US 10,777,929 B2
(45) Date of Patent: Sep. 15, 2020

(54) ELECTRICAL CONNECTOR AND METHOD MAKING THE SAME

(71) Applicants: FU DING PRECISION COMPONENT (SHEN ZHEN) CO., LTD., Shenzhen (CN); FOXCONN INTERCONNECT TECHNOLOGY LIMITED, Grand Cayman (KY)

(72) Inventors: Tzu-Yao Hwang, New Taipei (TW); Han-Hung Huang, New Taipei (TW)

(73) Assignees: FUDING PRECISION COMPONENTS (SHENZHEN) CO., LTD., Shenzhen (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/530,920

(22) Filed: Aug. 2, 2019

(65) Prior Publication Data

US 2020/0052429 A1 Feb. 13, 2020

(30) Foreign Application Priority Data

Aug. 8, 2018 (CN) ..... 2018 1 0894938

(51) Int. Cl.
*H01R 13/41* (2006.01)
*H01R 12/71* (2011.01)
(Continued)

(52) U.S. Cl.
CPC ..... *H01R 13/41* (2013.01); *H01R 12/716* (2013.01); *H01R 13/2442* (2013.01); *H01R 43/16* (2013.01); *H01R 43/20* (2013.01)

(58) Field of Classification Search
CPC .... H01R 12/57; H01R 12/714; H01R 12/716; H01R 13/41; H01R 13/2442; H01R 43/08; H01R 43/16; H01R 43/20; H05K 7/1069
See application file for complete search history.

(56) References Cited

U.S. PATENT DOCUMENTS 5,052,954 A * 10/1991 Seidler ..... H01R 12/57 29/843
5,100,338 A * 3/1992 Lu ..... H01R 12/57 439/326
(Continued)

*Primary Examiner* — Oscar C Jimenez
(74) *Attorney, Agent, or Firm* — Wei Te Chung; Ming Chieh Chang

(57) ABSTRACT

An electrical connector includes an insulative housing having a plurality of passageways arranged in matrix, and a plurality of contacts assembled and retained in the corresponding passageways, respectively. Each contact has a main body, a secondary body sidewardly connected to and angled with the main body. A resilient contacting section upwardly extends from an upper portion of the main body and above the top surface of the housing for contacting an electronic package, and a soldering section extends from a lower portion of the secondary body around the bottom surface of the housing for mounting to a printed circuit board. The main body includes an upper linking part originally linked to an upper carrier, and the secondary body includes a lower linking part which is originally linked to a lower carrier. The main body includes retaining structures for retaining the contact within the passageways without moving.

18 Claims, 11 Drawing Sheets

(51) Int. Cl.

| | |
|---|---|
| ***H01R 13/24*** | (2006.01) |
| ***H01R 43/16*** | (2006.01) |
| ***H01R 43/20*** | (2006.01) |

(56) References Cited

U.S. PATENT DOCUMENTS

| | | | | |
|---|---|---|---|---|
| 6,641,410 | B2 * | 11/2003 | Marvin | H01R 4/024 439/83 |
| 6,652,329 | B1 | 11/2003 | Howell et al. | |
| 6,929,483 | B2 * | 8/2005 | Huang | H01R 13/2442 439/66 |
| 6,969,286 | B1 * | 11/2005 | Mongold | H01R 12/57 439/874 |
| 7,497,743 | B2 * | 3/2009 | Tsai | H01R 13/2442 439/862 |
| 8,118,625 | B2 * | 2/2012 | Tsai | H01R 12/721 439/885 |
| 8,206,189 | B2 * | 6/2012 | Kanda | H01R 24/44 439/862 |
| 10,116,079 | B1 * | 10/2018 | Ju | H01R 12/57 |
| 2004/0229519 | A1 * | 11/2004 | Lappohn | H01R 13/41 439/733.1 |
| 2010/0248557 | A1 * | 9/2010 | Fan | H01R 43/16 439/816 |
| 2011/0065338 | A1 * | 3/2011 | Zhang | H01R 43/16 439/862 |
| 2011/0256780 | A1 * | 10/2011 | Peng | H01R 12/55 439/676 |
| 2012/0100758 | A1 | 4/2012 | Liaw et al. | |
| 2014/0345134 | A1 * | 11/2014 | Zebhauser | H01R 43/02 29/884 |
| 2019/0280415 | A1 * | 9/2019 | Huang | H01R 13/40 |
| 2020/0106203 | A1 * | 4/2020 | Hwang | H01R 13/2442 |

* cited by examiner

ELECTRICAL CONNECTOR AND METHOD MAKING THE SAME

FIELD OF THE DISCLOSURE

The invention is related to an electrical connector, and particularly to an electrical connector with the corresponding contacts each having an upper linking part operated with a first assembling tool and a lower linking part operated with a second assembling tool so as to have each contact reliably retained in the corresponding passageway via a sequential assembling procedure.

DESCRIPTION OF RELATED ARTS

As shown in U.S. Pat. No. 9,142,932, the electrical connector includes an insulative housing with a plurality of passageways therein, and a plurality of contacts respectively retained in the corresponding passageways with the corresponding contacting sections extending above the top surface of the housing. Understandably, the contacts are required to be assembled or inserted into the corresponding passageways via a contact carrier having a linking part which each contact is originally linked to and successively removed from after the contact has been inserted into the corresponding passageway in the final/correct position. In other words, during assembling the contact carrier is initially held by an assembling tool to simultaneously push the same row contacts into the corresponding passageways to reach their final/correct position and is successively removed from the contacts by breaking away from the corresponding linking parts of such contacts via simultaneously back-and-forth swinging about connecting edges of the linking parts. Because the resilient contacting sections of the contacts are required to be exposed above the top surface of the housing, the contacts are required to be downwardly assembled into the corresponding passageways via the carrier which is linked on the linking part of the contacts above the top surface of the housing. Understandably, the linking edge of the linking part is essentially flush with the top surface of the housing for facilitating such a back-and-forth swinging. It is because on one hand the linking part of the contact which is linked to the carrier, is not expected to be significantly exposed above the top surface of the housing after the carrier is removed therefrom, and on the other hand it is impossible to efficiently back and forth swing the carrier if the lining edges of the linking parts are relatively located below the top surface of the housing.

Anyhow, because the pitch of the neighboring contacts in matrix in the housing becomes smaller and smaller, it is relatively difficult to efficiently back and forth swing the carrier without interfering with the neighboring resilient contacting sections, thus resulting in damage of the contacting sections of the contacts possibly. It is especially true when the linking edges of the linking parts are located close to the top surface of the housing.

It is desired to provide a new design for the contact of the connector which may be reliably assembled into the corresponding passageways via a plural sequential hybrid processes instead of the single pushing process used by the traditional connector.

SUMMARY OF THE DISCLOSURE

To achieve the above desired purpose, an electrical connector includes an insulative housing having opposite top and bottom surfaces thereof and formed with a plurality of passageways arranged in matrix and extending through both the top surface and bottom surface in the vertical direction, and a plurality of contacts assembled and retained in the corresponding passageways, respectively. Each contact has a main body, a secondary body sidewardly connected to and angled with the main body in a top view. A resilient contacting section upwardly extends from an upper portion of the main body and above the top surface of the housing for contacting an electronic package having the pads thereon, and a soldering section extends from a lower portion of the secondary body around the bottom surface of the housing for mounting to a printed circuit board. The main body includes an upper linking part originally linked to an upper carrier, and the secondary body includes a lower linking part which is originally linked to a lower carrier. The main body includes retaining structures for retaining the contact within the passageways without moving.

During assembling the contacts into the corresponding passageways, the crossbar of the lower carrier should be removed firstly so only the discrete linking legs of the first carrier remain to connect to the corresponding lower linking parts of the corresponding contacts. Via an upper assembling tool applied upon the upper carrier to bring about a downward pushing effect, the contacts commonly linked by the same upper carrier, are simultaneously inserted downwardly into the corresponding passageways from the top surface of the housing to an initial upper position. The upper carrier including the crossbar and the lining legs, is successively removed from the corresponding upper linking parts of the contacts via an operation of back and forth swinging. A lower assembling tool is further applied upon the lower linking parts of the contacts to bring about a downward pulling effect so as to move the contacts from the initial upper positions to a final lower positions. Finally, the linking legs of the lower carrier are removed from the lower linking parts of the corresponding contacts via another operation of back and forth swinging.

Compared with the traditional contact design which only has one upper linking part to connect to one upper carrier and assembled into the corresponding passageway with one pushing effect and one breaking operation, the contact of the instant invention has one upper linking part originally connected to one upper carrier and one lower linking part originally connected to one lower carrier with one pushing effect, one pulling effect and two breaking operation. Understandably, via this arrangement, the contacts may be easily and correctly inserted into the corresponding passageways in the correct positions without potentially damaging the corresponding neighboring contacting sections because the operation of back-and-forth bending/breaking/swinging of the upper carrier is done in a relatively sufficient space, i.e., the contacts being located in the initial upper positions where the linking edges of the corresponding upper linking parts is relatively far from the top surface of the housing.

DETAILED DESCRIPTION OF THE PREFERRED EMBODIMENT

Figure 1:
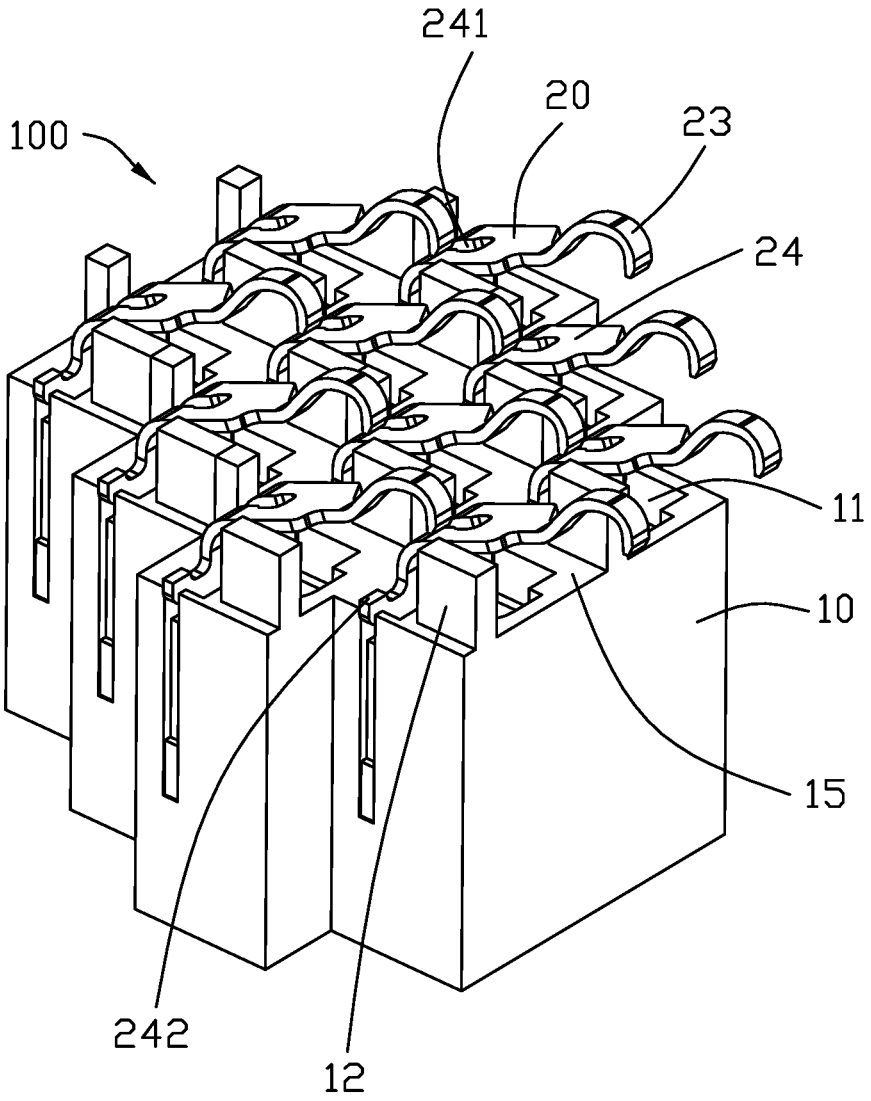
FIG. 1 is a perspective view of an electrical connector of the invention.
Figure 2:
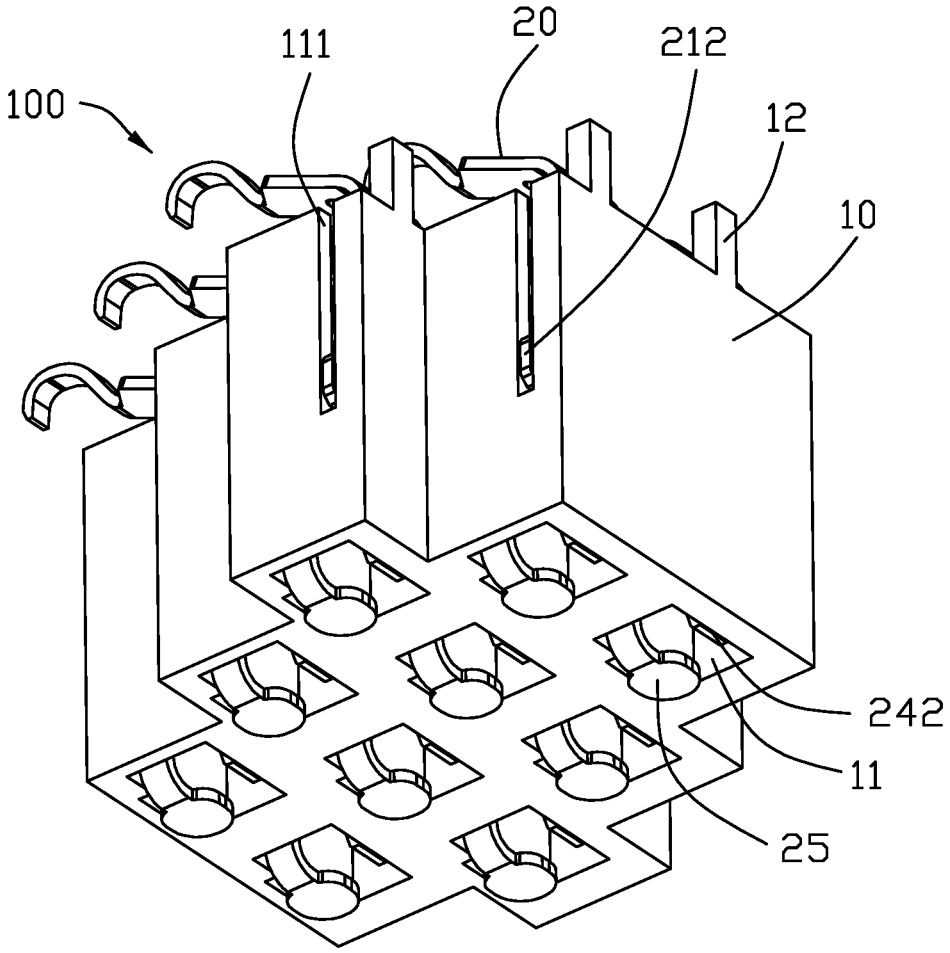
FIG. 2 is another perspective view of the electrical connector of FIG. 1.
Figure 3:
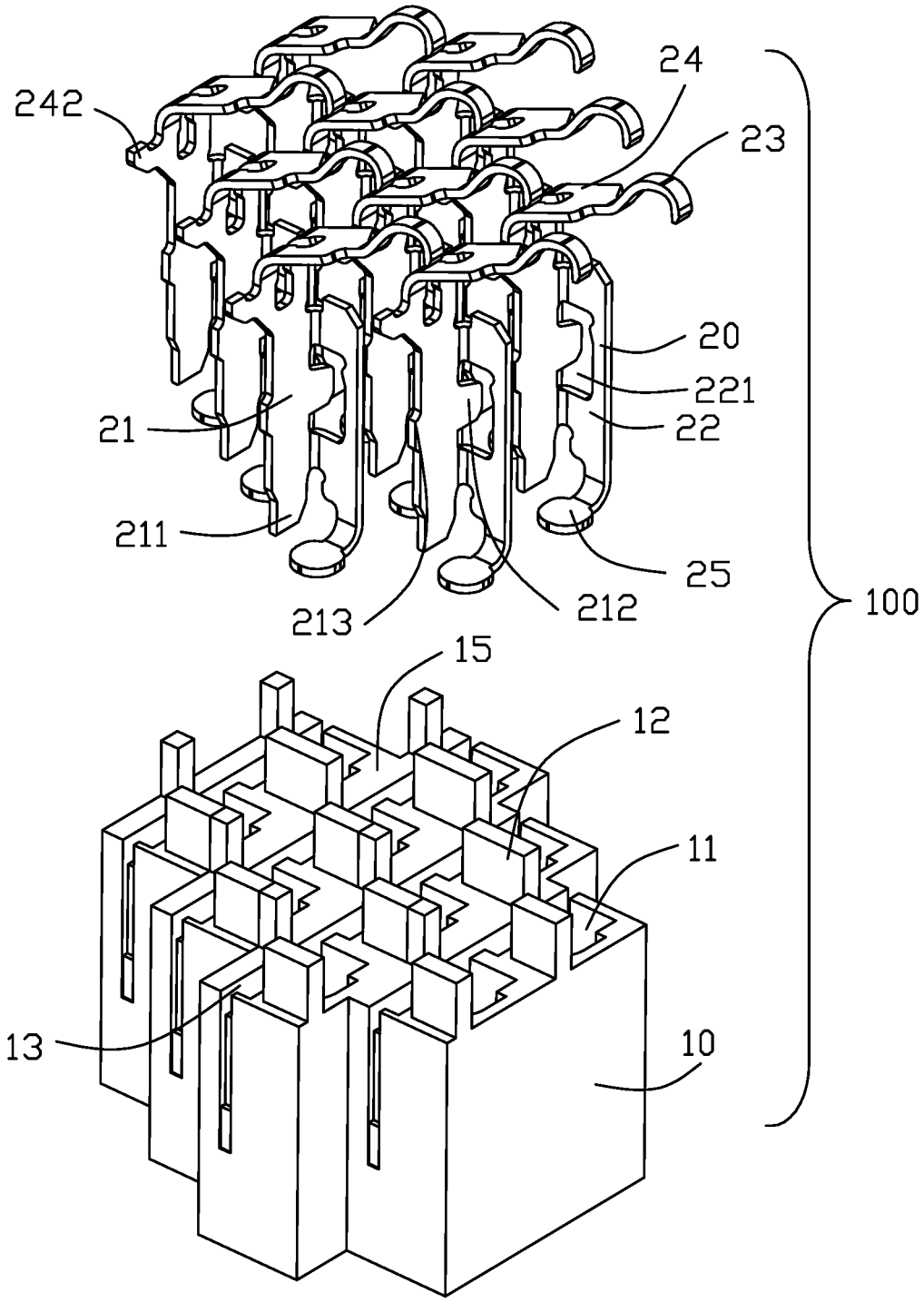
FIG. 3 is an exploded perspective view of the electrical connector of FIG. 1.
Figure 4:
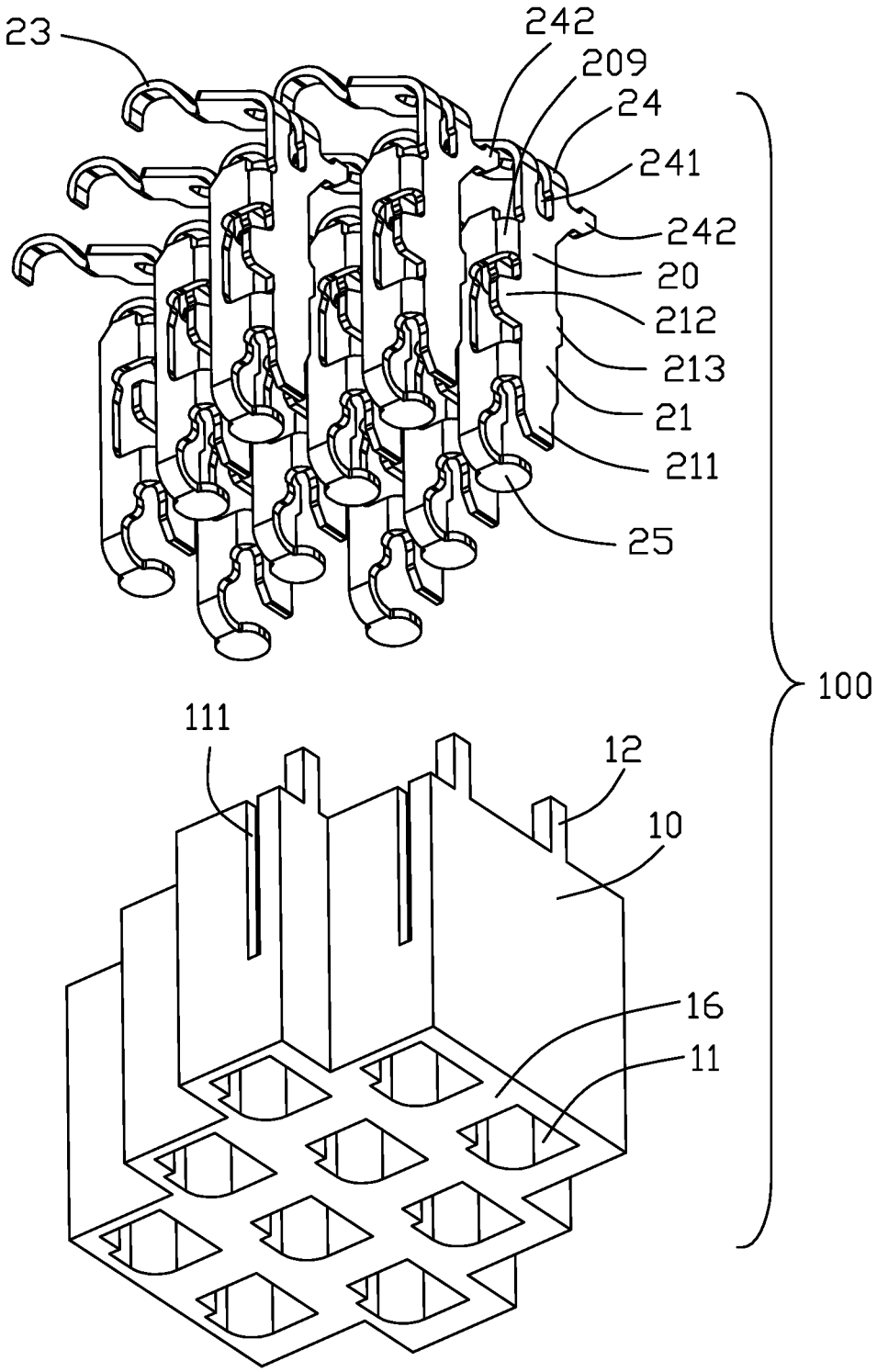
FIG. 4 is another exploded perspective view of the electrical connector of FIG. 3.
Figure 5:
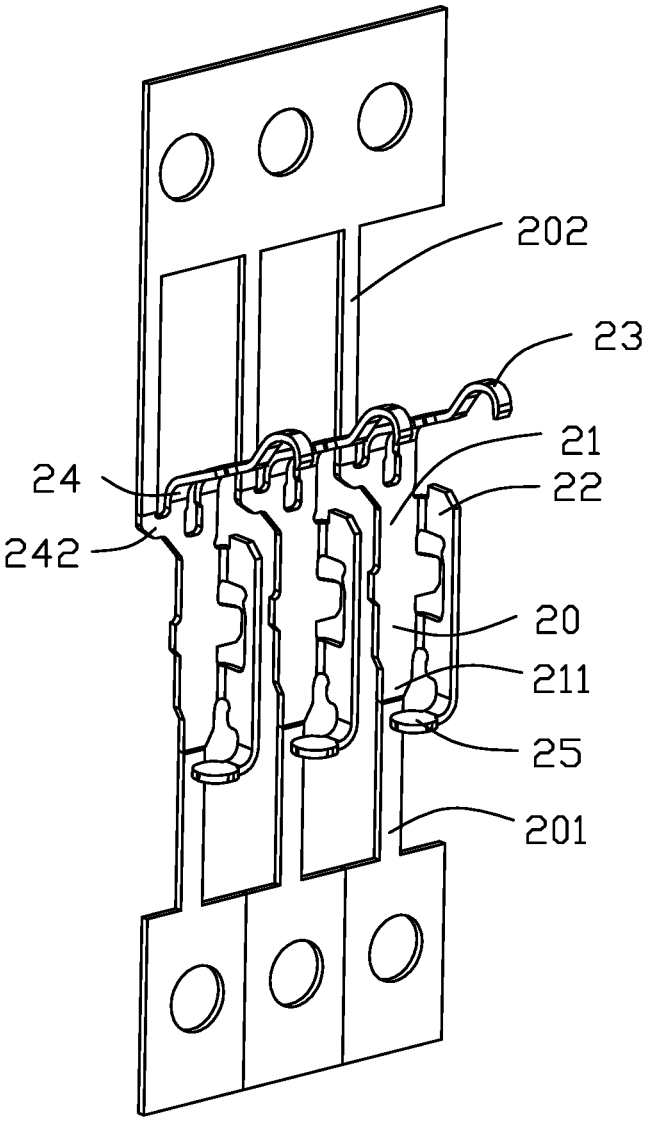
FIG. 5 is a perspective view of the contacts in the same row of the electrical connector of FIG. 1 wherein both the upper carrier and the lower carrier are not removed from the corresponding contacts.
Figure 6:
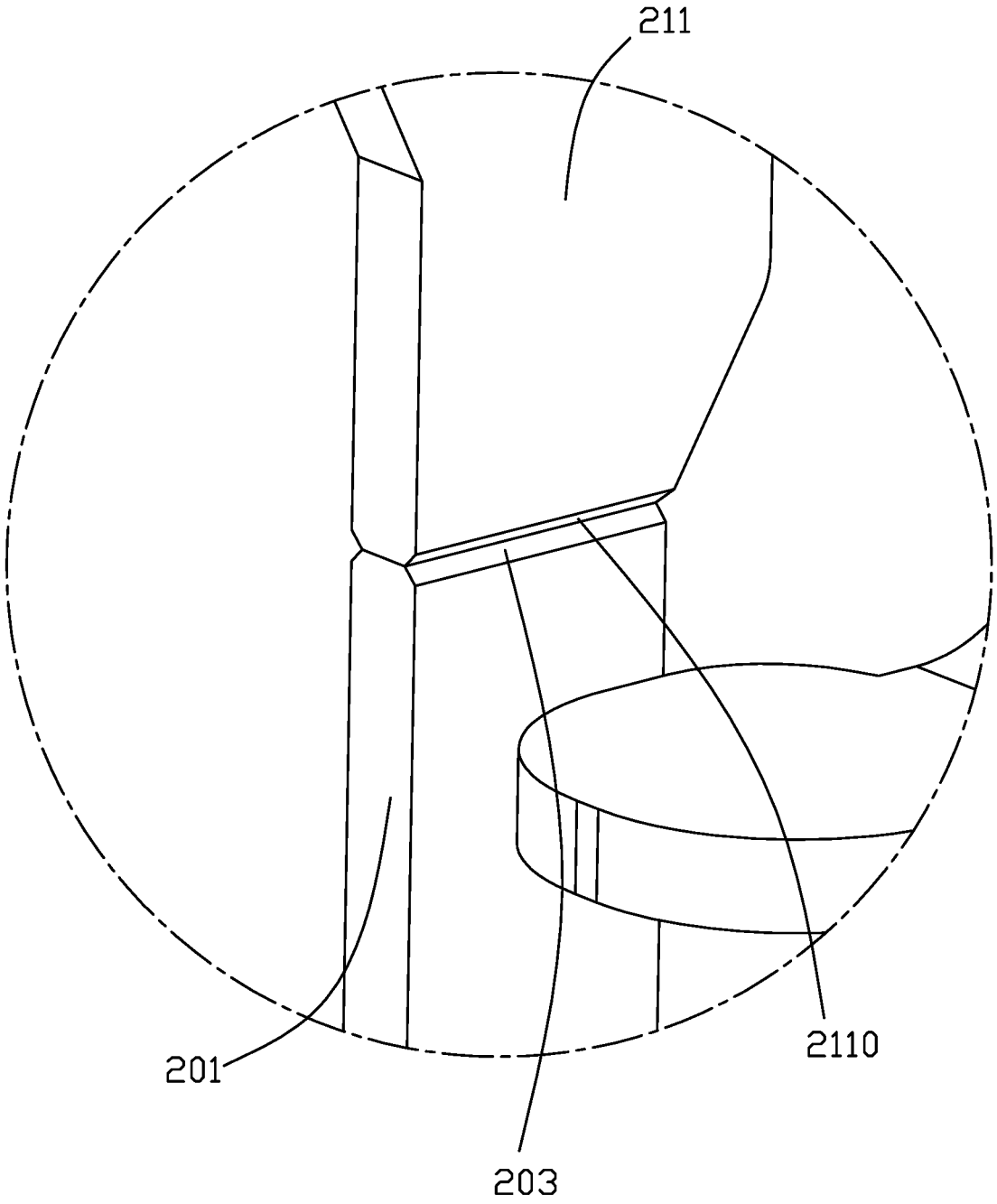
FIG. 6 is an enlarged perspective view of a portion of the contact of the electrical connector of FIG. 5.
Figure 7:
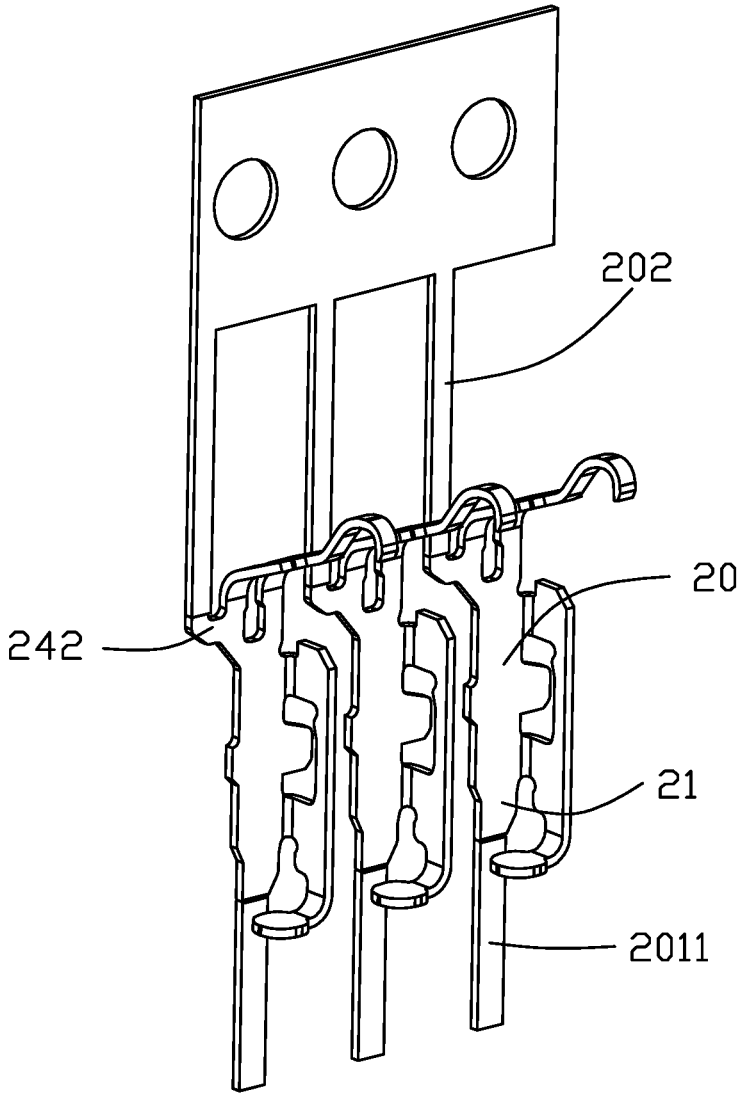
FIG. 7 is a perspective view of the contacts of the electrical connector of FIG. 5 wherein the cross bar of the lower carrier is removed from the linking legs of the lower carrier.
Figure 8:
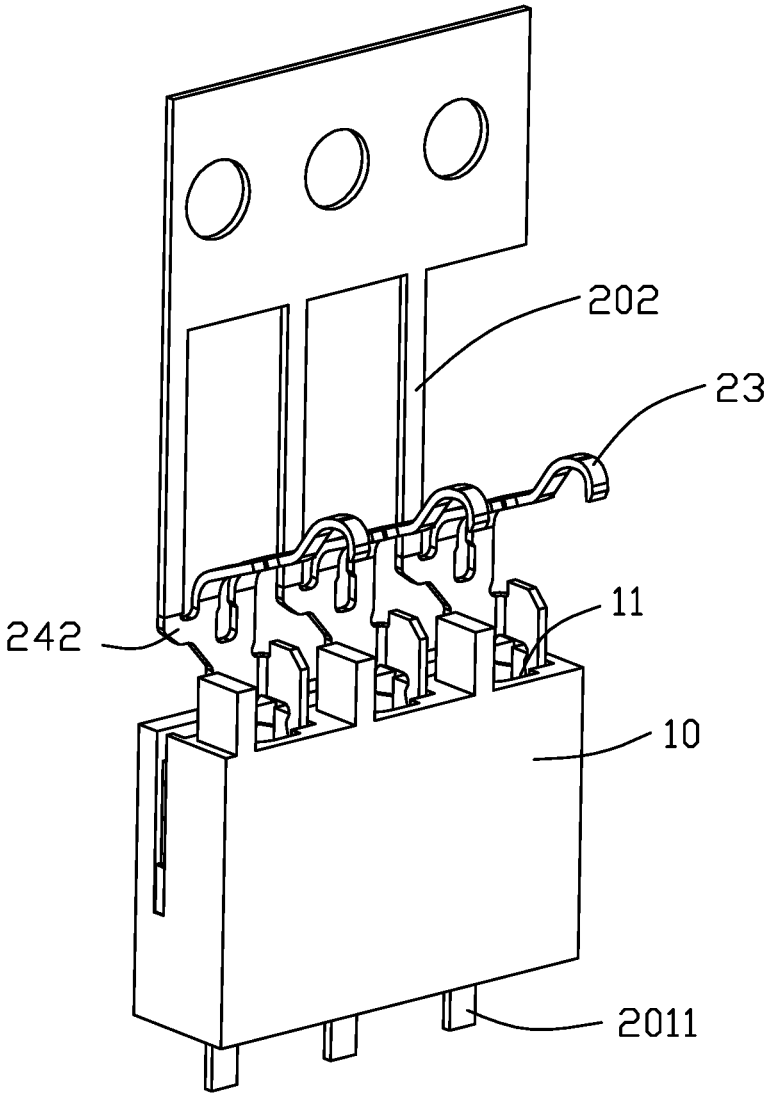
FIG. 8 is a perspective view of a portion of the electrical connector of FIG. 1 wherein the contacts are assembled into the corresponding passageways in the initial upper positions.
Figure 9:
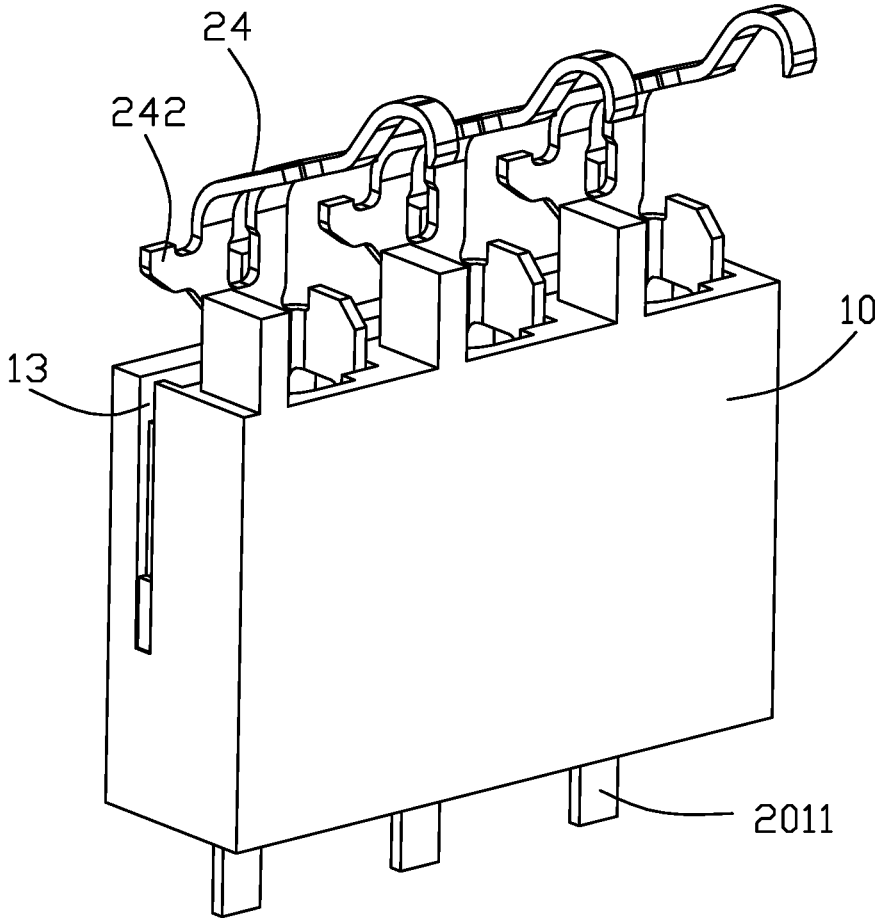
FIG. 9 is a perspective view of the portion of the electrical connector of FIG. 8 wherein the upper carrier is removed from the contacts.
Figure 10:
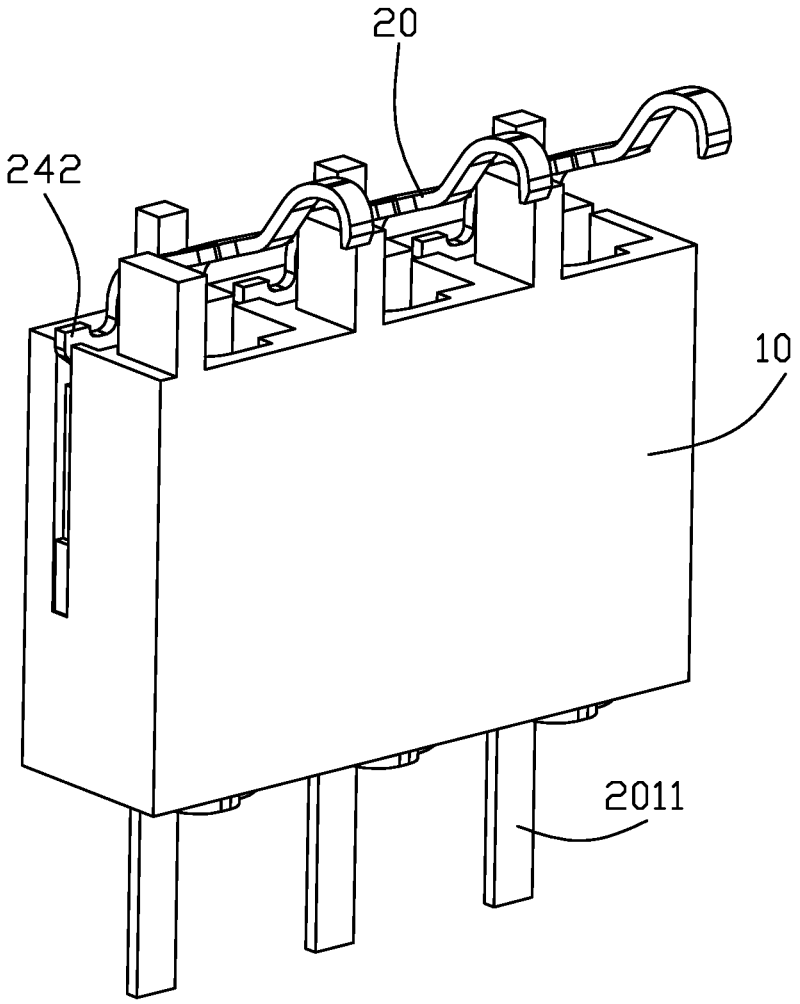
FIG. 10 is a perspective view of the portion of the electrical connector of the FIG. 9 wherein the contacts are moved to the final lower positions and FIG. 11 is a perspective view of the portion of the electrical connector of the FIG. 9 wherein the linking legs of the lower carrier are removed from the contacts.
Figure 11:
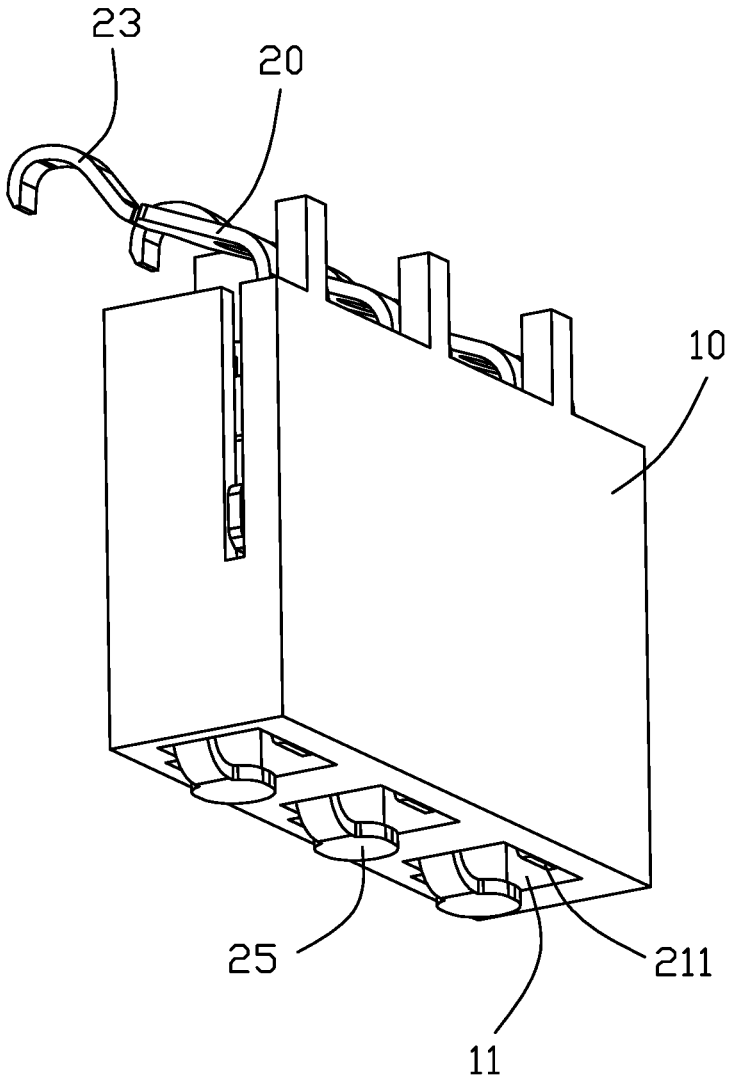

Reference will now be made in detail to the embodiment of the present disclosure. Referring to FIGS. 1-11, an electrical connector 100 for connecting an electronic package, i.e., a CPU (Central Processing Unit), and a PCB (printed circuit board), includes an insulative housing 10 and a plurality of contacts 20 therein.

The housing 10, which is not completely shown for easy illustration of the internal structures, forms opposite top surface 15 and bottom surface 16 and a plurality of passageways 11 extending through both the top surface 15 and the bottom surface 16 in the vertical direction for receiving the contacts 20 therein. A plurality of standoffs 12 are formed on the top surface 15 corresponding to one side of the corresponding passageways 11, respectively. Each passageway 11 further communicates with a first side groove 13 adjacent to the corresponding standoff 12, and a second side groove 111 opposite to the first side groove 13.

The contacts 20 are arranged in matrix. Each contact 20 includes a main body 21 and a secondary body 22 sidewardly connected and angled with the main body 21 in a top view, a spring section 24 connected to an upper portion of the main body 21, a resilient contacting section 23 extending upwardly and obliquely from the spring section 24, and a soldering/tail section 25 downwardly extending from a lower portion of the secondary body 22 with a solder ball thereon for soldering to the printed circuit board. Both the main body 21 and the secondary body 22 are received within the corresponding passageway 11. Both the spring section 24 and the contacting section 23 extend above the top surface 15.

The spring section 24 forms a narrow slot 241, and is wider than the contacting section 23. The width of the main body 21 is larger than that of the contacting section 23 while being smaller than that of the spring section 24. The narrow slot 241 of the spring section 24 is located proximate the stress concentration area so as to lower the impedance by adjusting the dimension and the position of the narrow slot. A first retention tab 212 is formed on one lateral side edge of the main body 21 and located within an opening 221 formed by the secondary body 22, and a second retention tab 213 is formed on the other lateral side edge of the main body 21 opposite to the first retention tab 212 in a transverse direction. Both the first retention tab 212 and the second retention tab 213 are coplanar with the main body 21 for stabilization of the contact 20. After assembled, the first retention tab 212 is received within the second side groove 111.

Each row of contacts 20 are originally/initially linked together with a lower/first carrier 201 linking to a lower/first linking part 211 located on a bottom portion of the main body 21, and an upper/second carrier 202 linking to an upper/second linking part 242 located on a top portion of the main body 21 beside the spring section 24. A V-shape recess 203 is formed in the border between the lower carrier 201 and the lower linking part 222 for easy breaking thereabouts so as to form a tapered end 2110 of the first linking part 211. In this embodiment, the spring section 24 is located above a linking edge bordered between the upper linking part 242 and the upper carrier 202. The spring section 24 forms therein a slot (not labeled) aligned with the contacting section 23 along the extension direction.

When the contact 20 is fully assembled within the corresponding passageways 11, the upper linking part 242 is received within the corresponding first side groove 13 securely. Understandably, the retention between the upper linking part 242 and the housing 10 may not only enhance the stability of the contact 20 in the passageway 11 but also allow easy separation between the upper linking part 242 and the upper carrier 202 if such a separation occurs after the contact 20 is completely assembled within the passageway 11.

The method of making the connector 100 is as follows: (i) providing an insulative housing 10; (ii) removing the transversely extending crossbar of the lower carrier 201 with the respective remaining posts 2011 which are respectively linked with the lower linking parts 211 of the contacts 20; (iii) downwardly assembling/pushing the contacts 20 into the corresponding passageways 11 via applying a downwardly force upon the upper carrier 202 until the contacts 20 reach the predetermined upper position wherein the upper linking part 242 of each contact 20 is located above the top surface 15, and the remaining posts 2011 are not completely exposed below the bottom surface 16 but corresponding upper portions of those remaining posts 2011 are still located within the corresponding passageway 11; (iv) removing the upper carrier 202 from the upper linking parts 242 of the corresponding contacts 20; (v) holding the respective remaining posts 2011 by a tool to pull the contacts 20 downwardly to reach the final/lower position in the corresponding passageways 11 wherein the upper linking part 242 is snugly received within the corresponding first side groove 13 securely, and the respective remaining posts 2011 are essentially fully exposed under the bottom surface 16 for easy breaking; and removing the respective remaining posts 2011 from the corresponding lower linking parts 211 to finalize assembling of the whole connector 100.

As mentioned before, the traditional contacts are basically linked to only one carrier with one step insertion/pushing for assembling the contact into the corresponding passageway. The drawback of such a traditional design is the difficulties for removing the carrier from the linking parts of the contacts without damaging or interfering with the neighboring contacting sections of the contacts due to the limited space thereabouts in a fine pitch arrangement. Differently the instant invention uses two opposite carriers respectively linked/operated at opposite upper/lower sides of the contact, thus providing the sufficient space above the top surface of the housing for easy removal of the upper carrier from the upper linking parts of the contacts. The upper carrier and the lower carrier respectively linked to the opposite upper linking part and lower linking part of the contact, is the main feature of the invention. In addition, the invention using two steps assembling, i.e., the initial/upper position and the final/lower position of the contact, is another feature of the invention wherein the upper carrier is removed when the contacts are located at the upper positions with regard to the housing. Because of the remaining posts which does not exist in the traditional design, the contacts can be moved from the upper/initial position to the lower/final position by another tool applied on such remaining posts, and then those respective remaining posts can be easily removed from the corresponding lower linking part around the bottom surface of the housing because no significantly extending part of the contact is located beside the lower linking part to be damaged due to the bending operation of removing the remaining posts. In brief, through the two carriers structure, variability of the contact design is increased, and further through the two steps assembling method, manufacturability of the fine pitch connector is increased, advantageously.

While a preferred embodiment in accordance with the present disclosure has been shown and described, equivalent modifications and changes known to persons skilled in the art according to the spirit of the present disclosure are considered within the scope of the present disclosure as described in the appended claims. For example, to efficiently holding of the remaining post, the contour of the remaining post can be of an upside-down T configuration instead of the straight type. Also, in this embodiment because of the final pitch arrangement of the contacts, the upper linking part 242 should be offset from the junction 209 in the vertical direction for no interference therebetween for the two neighboring contacts. In addition, in this embodiment, the soldering section 25 extends from the secondary body 22 and the first linking part 211 is located on a bottom portion of the main body 21. Alternately, the soldering section 25 extends from the main body 21 while the first linking part 211 is located on the bottom portion of the secondary body 22. Similarly, the upper linking part 242 can be located on an upper portion of the secondary body 22 instead of the main body 21. Also, the retention tabs 212, 213 may be formed on the secondary body 22 instead of the main body 21. Generally speaking, the main body 21 and the secondary body 22 can be deemed as one body portion extending in two planes angled with each other. In this embodiment, the lower carrier 201 originally includes the transversely extending crossbar integrating the corresponding remaining posts 2011 together. Understandably, the transversely extending crossbar may stabilize the respective contacts during stamping and forming the respective contacts. Anyhow, in an alternate inferior embodiment, the lower carrier 201 may include only the posts 2011 linked to the corresponding lower linking part 211 without the transversely extending crossbar when the whole contact assembly is formed so as to allow such a contact assembly to be directly assembled into the corresponding passageways 11 without additional step of removing the transversely extending crossbar of the lower carrier. From a technical viewpoint, the upper linking part and the lower linking part are preferred to be formed on the body portion where the retention tabs are located for achieving the efficient mechanical force arrangement. In this embodiment, both the upper carrier and the lower carrier are originally unitarily formed with the contacts for easy and efficient forming the whole contact assembly. Alternately, the upper carrier may be discrete from the contacts with an attachable manner if the contacting section is enlarged and the material of the contacts and that of the upper carrier may interfere with each other.

What is claimed is:

1. An electrical connector assembly comprising:

an insulative housing having two opposite top surfaces and bottom surfaces, a plurality of passageways in matrix formed in the housing and extending through both the top surface and the bottom surface;

a plurality of contacts retained in the corresponding passageways, respectively, each of said contacts including:

a body portion, a spring section extending from the body portion;

a contacting section extending from the spring section and above the top surface for contacting an electronic package;

a tail section extending from a lower portion of the body portion for mounting to a printed circuit board;

an upper linking part formed on an upper portion of the body portion for linking to an upper carrier which is requisitely removed from the contacts after the contacts have been assembled into the corresponding passageways; and a lower linking part formed on a lower portion of the body portion for linking to a lower carrier which is requisitely removed from the contacts after the contacts have been fully assembled into the corresponding passageways; wherein due to the contacting sections of the contacts dimensionally larger than the corresponding passageways, the contacts associated with corresponding posts of said lower carrier are requisitely downwardly inserted into the corresponding passageways from the top surface of the housing by the upper carrier which is exposed above the top surface.

2. The electrical connector assembly as claimed in claim 1, wherein the body portion includes a main body and a secondary body angled and linked with each other via a junction.

3. The electrical connector assembly as claimed in claim 2, wherein the spring section extends from an upper portion of the main body while the tail section extends from a lower portion of the secondary body.

4. The electrical connector assembly as claimed in 2, wherein both said upper linking part and said lower linking part are formed on the main body.

5. The electrical connector assembly as claimed in claim 4, wherein the spring section extends from an upper portion of the main body and side by side arranged with the upper linking part.

6. The electrical connector assembly as claimed in claim 5, wherein the main body is further equipped with at least one retention tab for securing the contact in the passageway.

7. The electrical connector assembly as claimed in claim 6, wherein corresponding to each passageway, the housing forms a side groove to receive the retention tab.

8. The electrical connector assembly as claimed in claim 6, wherein the retention tab is located in a vertical direction between two junctions formed between the main body and the secondary body.

9. The electrical connector assembly as claimed in claim 1, wherein all the contacts, the upper carrier and the lower carrier are unitarily formed together originally.

10. A method of making an electrical connector comprising steps of: providing an insulative housing with a plurality of passageways extending therethrough in a vertical direction; forming a contact assembly with one row of contacts thereof and an upper carrier and a lower carrier wherein the contact includes a body portion with a contacting section extending above a top surface of the housing and a tail section around a bottom surface of the housing, the upper carrier is adapted to be connected to an upper linking part formed on an upper portion of the body portion, and the lower carrier is adapted to be connected to a lower linking part formed on a lower portion of the body portion; and removing a transversely extending crossbar of the lower carrier and holding the upper carrier to downwardly insert the contacts into the corresponding passageways from the top surface of the housing, respectively; including a step of removing the upper carrier after the contacts have been assembled into the corresponding passageways, respectively; wherein after removal of the transversely extending crossbar of the lower carrier, the lower carrier includes a plurality of remaining posts linked to the lower linking parts of the corresponding contacts, respectively, and said remaining posts are downwardly inserted into the corresponding passage with the corresponding contacts during the step of holding the upper carrier to downwardly insert the contacts into the corresponding passageways, respectively.

11. The method as claimed in claim 10, wherein each of the contacts is not fully assembled into the corresponding passageway but located at an initial upper position rather than at a final lower position.

12. The method as claimed in claim 11, after removing the upper carrier, further including a step of holding the remaining posts, which are exposed below a bottom surface of the housing, to downwardly pull each of the contacts to move from the upper position to lower position.

13. The method as claimed in claim 12, after holding the remaining posts to downwardly pull each of the contacts, further including a step of removing the remaining posts from the lower linking parts of the corresponding contacts, respectively, to finalize the whole connector.

14. An electrical connector assembly comprising:

an insulative housing having two opposite top surfaces and bottom surfaces, a plurality of passageways in matrix formed in the housing and extending through both the top surface and the bottom surface;

a plurality of contacts retained in the corresponding passageways, respectively, each of said contacts including:

a body portion, a spring section extending from an upper portion of the body portion;

a contacting section extending from the spring section and above the top surface for contacting an electronic package;

a tail section extending from a lower portion of the body portion for mounting to a printed circuit board;

an upper linking part formed on an upper portion of the body portion for linking to an upper carrier which is requisitely removed from the contacts after the contacts have been assembled into the corresponding passageways; and a lower linking part formed on a lower portion of the body portion for linking to a lower carrier which is requisitely removed from the contacts after the contacts have been fully assembled into the corresponding passageways; wherein due to the contacting sections of the contacts dimensionally larger than the corresponding passageways, the contacts associated are downwardly inserted into the corresponding passageways from the top surface of the housing by the upper carrier which is exposed above the top surface, after a transversely extending crossbar of the lower carrier has been removed.

15. The electrical connector assembly as claimed in claim 14, wherein the body portion includes a planar main body on which both the upper linking part and the lower linking part and at least one retention tab are formed.

16. The electrical connector assembly as claimed in claim 15, wherein the upper linking part and the spring section are side by side arranged with each other.

17. The electrical connector assembly as claimed in claim 16, wherein a linking edge bordered between the upper linking part and the upper carrier is lower than the spring section in a vertical direction.

18. The electrical connector assembly as claimed in claim 17, wherein the spring section forms a slot aligned with the contacting section along an extension direction.

* * * * *